US008132685B2

(12) United States Patent
Wellman

(10) Patent No.: US 8,132,685 B2
(45) Date of Patent: Mar. 13, 2012

(54) TWO-PART CLOSURE FOR A CONTAINER

(75) Inventor: Craig Wellman, Ingleburn (AU)

(73) Assignee: Pathtainer Systems International Pty. Ltd. (AU)

( * ) Notice: Subject to any disclaimer, the term of this patent is extended or adjusted under 35 U.S.C. 154(b) by 1873 days.

(21) Appl. No.: 11/260,695

(22) Filed: Oct. 27, 2005

(65) Prior Publication Data

US 2006/0102584 A1 May 18, 2006

(30) Foreign Application Priority Data

Nov. 18, 2004 (AU) ..... 2004906601

(51) Int. Cl.
*B65D 41/34* (2006.01)

(52) U.S. Cl. ..... 215/352; 215/44; 215/45; 215/344; 220/259.4; 220/254.8

(58) Field of Classification Search ..... 220/259.3, 220/259.4; 215/329, 330, 352, 344, 256, 215/253, 44, 249, 254.8
See application file for complete search history.

(56) References Cited

U.S. PATENT DOCUMENTS

| | | | | | |
|---|---|---|---|---|---|
| 2,305,197 | A | | 12/1942 | Sheridan | |
| 2,364,126 | A | * | 12/1944 | Cantor et al. | 215/247 |
| 3,434,615 | A | * | 3/1969 | Barletta | 215/276 |
| 3,787,547 | A | | 1/1974 | Stephan | |
| 3,871,545 | A | * | 3/1975 | Bereziat | 215/249 |
| 4,136,796 | A | * | 1/1979 | Dubois et al. | 220/259.4 |
| 4,896,782 | A | * | 1/1990 | Hawkins et al. | 215/329 |
| 5,174,460 | A | * | 12/1992 | Minnette | 215/335 |
| 5,251,788 | A | * | 10/1993 | Moore | 222/111 |
| 5,320,232 | A | * | 6/1994 | Maguire et al. | 215/245 |
| 5,332,113 | A | * | 7/1994 | Kusler et al. | 215/249 |
| 5,360,127 | A | * | 11/1994 | Barriac et al. | 215/263 |
| 5,740,932 | A | | 4/1998 | Battegazzore | |
| 6,523,710 | B1 | * | 2/2003 | Hidding et al. | 215/252 |
| 6,619,492 | B2 | | 9/2003 | Battegazzore | |

FOREIGN PATENT DOCUMENTS

| | | |
|---|---|---|
| FR | 2 490 598 | 3/1982 |
| WO | WO 2004/078613 A1 | 9/2004 |

OTHER PUBLICATIONS

Examiner-made diagram based on Figure 4 of US Pat. No. 5,320,232. 2011.*

* cited by examiner

*Primary Examiner* — Anthony Stashick
*Assistant Examiner* — James N Smalley
(74) *Attorney, Agent, or Firm* — Olson & Cepuritis, Ltd.

(57) ABSTRACT

A closure for a container (14) comprises a first portion (12) for mounting to the container and a second portion (10) adapted for mounting to the first portion. When the second portion is removed from the first portion it opens the container. When the first portion is mounted to the container and a deformable seal (66) is positioned therebetween, and when the second portion is then mounted to the first position, the seal is deformed and is simultaneously able to seal between the first portion and the container, and between the first portion and the second portion.

16 Claims, 10 Drawing Sheets

TWO-PART CLOSURE FOR A CONTAINER

TECHNICAL FIELD

A two-part closure for a container is disclosed. The closure/container combination finds particular though not exclusive use in the tamper proof storage of substances.

BACKGROUND ART

The use of tamper proof and tamper evident storage containers has increased in recent years. For example, containers for foodstuffs, pharmaceuticals, cosmetics, and other comestibles requiring storage and delivery often employ tamper evident bands, seals or the like between a closure and the container. Some containers for industrial chemicals are now also employing tamper evident bands. Tamper proofing arrangements are employed to prevent access to container contents, usually until a portion of the closure for the container is in some way broken, ruptured or disintegrated to enable closure removal.

In the field of sports drug testing, the tamper proof storage of specimens has more significance. In WO 01/30663, the applicant has previously developed a tamper proof and tamper evident container for use, inter alia, in the storage of samples for sports drug testing.

SUMMARY

In a first aspect there is provided a closure for a container, the closure comprising:

a first portion for mounting to the container; and a second portion adapted for mounting to the first portion, such that:

(a) when the second portion is removed from the first portion it opens the container; and (b) when the first portion is mounted to the container and a seal is positioned therebetween, and when the second portion is mounted to the first portion, the seal is simultaneously able to seal between the first portion and the container, and between the first portion and the second portion.

A closure configured in this manner can be securely sealed, and yet is easy and rapid to open and close without compromising the seal after re-closure. Such a seal may also secure the container contents against somewhat extreme external conditions (eg. heating etc). Such a closure may tamper-proof the container, for example, where the container is holding a substance which should not be contaminated and/or easily accessed (eg. a specimen, a valuable substance etc).

Employing a two-portioned closure also enables the first portion to be fastened (eg. permanently locked) to the container, and enables the second portion to be removably fastened to the first portion (eg. using a tamper-evident fastening therebetween). For example, in a typical use of the closure, once a substance has been placed in the container, the assembled closure (ie. with the tamper-evident fastening already established between the first and second portions) can be mounted to the container. Thereafter, access to the substance may only be obtained by removing/breaking the tamper-evident fastening between the first and second portions, allowing the second portion to be detached from the first portion, to thereby provide access to the substance in the container.

Typically the second portion comprises an internal skirt that extends within the first portion such that, when the first portion is mounted to the container, the internal skirt is located adjacent to the seal. For example, whilst the second portion is mounted to the first portion, when the first portion is mounted to the container the seal can be caused to be forced inwardly against the internal skirt.

Typically the seal is a gasket positionable in an internally located rebate within the first portion. This location prevents the seal from being tampered with. The gasket may comprise a deformable polymeric O-ring. By providing a deformable gasket, as the first portion is mounted to the container, the gasket can be squeezed to deform inwardly against the internal skirt of the second portion, to effect the sealing between the first portion, second portion and container.

Typically once the first portion is mounted to the container it is locked thereto. Such an arrangement may thus only allow container access by detaching the second portion from the first portion.

For example, the first portion can be rotationally mounted then locked to the container via a bayonet or screw thread coupling. Either coupling may then comprise an anti-rotational locking mechanism such that, after rotational mounting of the first portion to the container, the locking mechanism is engaged to prevent counter rotation and thus detachment of the first portion from the container. In addition, when the first portion is locked to the container, typically the anti-rotational locking mechanism is covered by an external subtending skirt of the first portion, to prevent the locking mechanism from being tampered with.

Typically the external subtending skirt of the first portion is received into a recess defined in and around a peripheral flange projecting outwardly from and surrounding the container. This arrangement further prevents the locking mechanism from being tampered with.

Typically the first portion is mountable to a rim of the container located at and surrounding a container opening such that, when the first portion is mounted to the rim, the seal is engaged against a free end of the rim, and is sandwiched between an internal wall of the first portion and the rim free end. This configuration can maximise the sealing function of the seal.

Typically the second portion comprises an external skirt subtending therefrom, the skirt surrounding a corresponding projecting wall of the first portion when the second portion is mounted thereto. A screw thread may be positioned between the external skirt and corresponding projecting wall, such that the second portion can be screw mounted to the first portion. The screw thread can enhance fastening of the second portion to the first portion and can allow for easy detachment of the second portion from the first portion.

A peripherally extending band may be provided that subtends from a free edge of the second portion external skirt. This band may then be located adjacent to the corresponding projecting wall when the second portion is mounted to the first portion. Typically, after the second portion is mounted to the first portion, the band is fastened to the corresponding projecting wall of the first portion. Thus, the band may provide additional fastening of the second portion to the first portion.

In a simple manufacturing procedure, the band may be fastened to the corresponding projecting wall of the first portion by:

overmoulding a polymeric material around the band;

welding the band to the corresponding projecting wall.

Typically the band is over-moulded with a thermo-plastic elastomeric material.

When the band is welded to the corresponding projecting wall, typically it comprises a further peripheral skirt subtending from a free edge of the band, with the further peripheral skirt then being welded to the corresponding projecting wall.

This further peripheral skirt is typically frangibly connected to the free edge of the band, to enable the band to be detached from the corresponding projecting wall after welding.

In a typical application, the band is a tear strip frangibly connected to the edge of the second portion external skirt such that it can be manually torn away therefrom. In this regard, the band may comprise a protruding portion for gripping that enables manual initiation of tearing.

Thus, when a polymeric material is over-moulded around the band, manual tearing of the band away from the wall severs it from both the free edge of the second portion external skirt and from the over-moulded polymeric material. When the band is welded to the wall, manual tearing of the band away from the wall severs it from both the free edge of the second portion external skirt and from the further peripheral skirt.

In a second aspect there is provided a closure for a container, the closure comprising a first portion for mounting to the container, and a second portion for mounting to the first portion;

wherein, when the first portion is mounted to the container it is locked thereto; and wherein, when the first portion is locked to the container, the second portion can be removed from the first portion to open the container.

As with the first aspect, the use of a two-portioned closure enables the first portion to be locked (eg. permanently) to the container, and then enables the second portion to be eg. removably fastened to the first portion. In this regard, a tamper-evident fastening can be employed between the first and second portions.

Typically the closure of the second aspect is otherwise as defined in the first aspect.

In a third aspect there is provided a closure for a container, the closure comprising a first portion for mounting to the container, and a second portion for mounting to the first portion, the second portion comprising an external skirt which surrounds a corresponding projecting wall of the first portion when the second portion is mounted thereto, with a peripherally extending band subtending from an end of the external skirt and located adjacent to the corresponding projecting wall when the second portion is mounted to the first portion;

wherein the band can be fastened to the corresponding projecting wall and can then be detached from the second portion, to enable the second portion to be detached from the first portion and thereby open the container.

Typically the band of the third aspect is otherwise as defined in the first aspect.

In a fourth aspect there is provided a container suitable for use with the closure as defined in any one of the first, second or third aspects.

BRIEF DESCRIPTION OF THE DRAWINGS

Notwithstanding any other forms which may fall within the scope of the closure and container as defined in the Summary, specific embodiments of the closure and container will now be described, by way of example only, with reference to the accompanying drawings in which.

DETAILED DESCRIPTION OF SPECIFIC EMBODIMENTS

Figure 1:
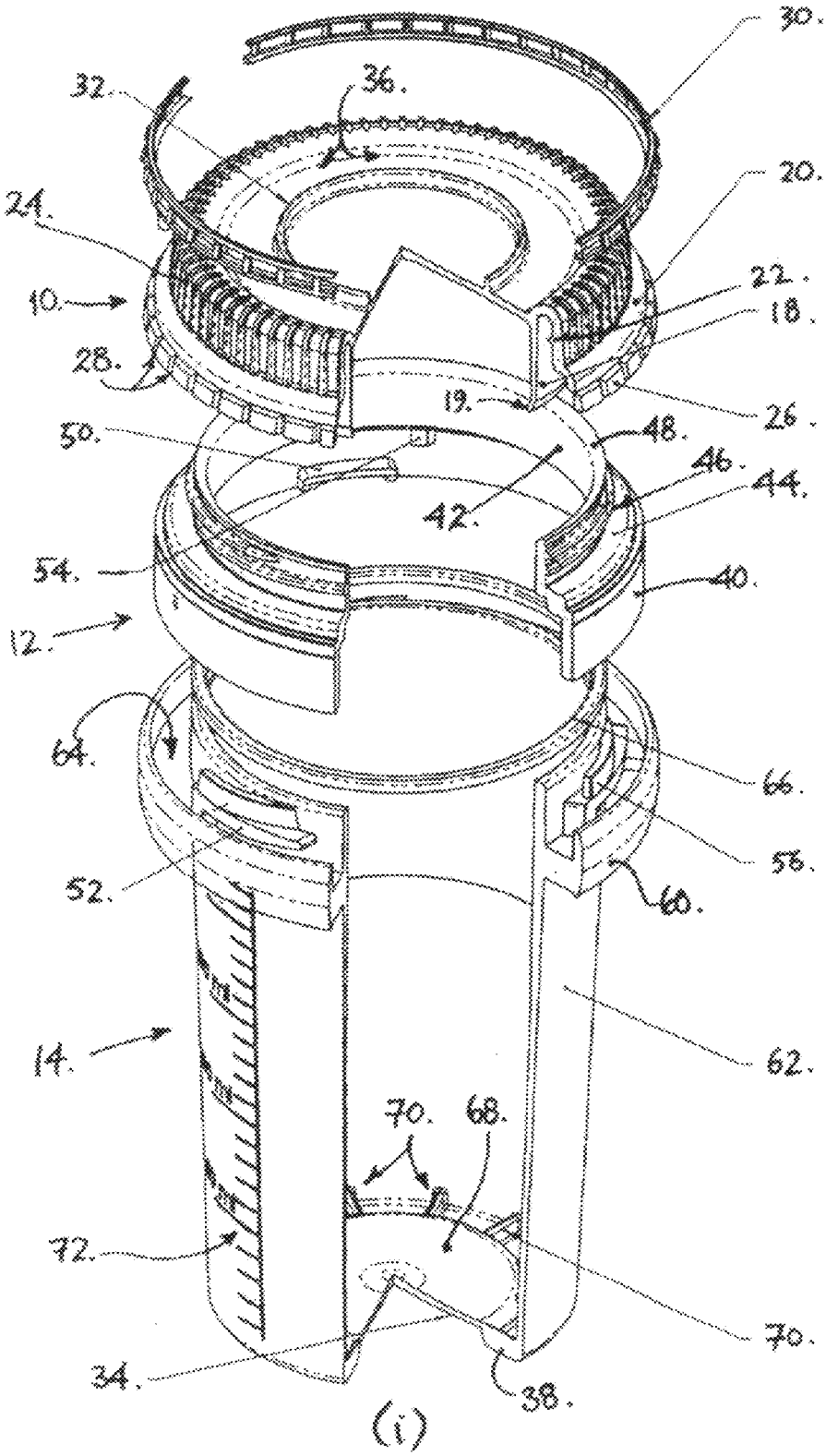
FIGS. 1(*i*), (*ii*), (*iii*), (*iv*) and (*v*) respectively show exploded perspective, assembled plan, assembled side, assembled side sectional elevations and an assembled side sectional detail of a two-part lid embodiment, and of a jar embodiment suitable for use with the lid.
Figure 1:
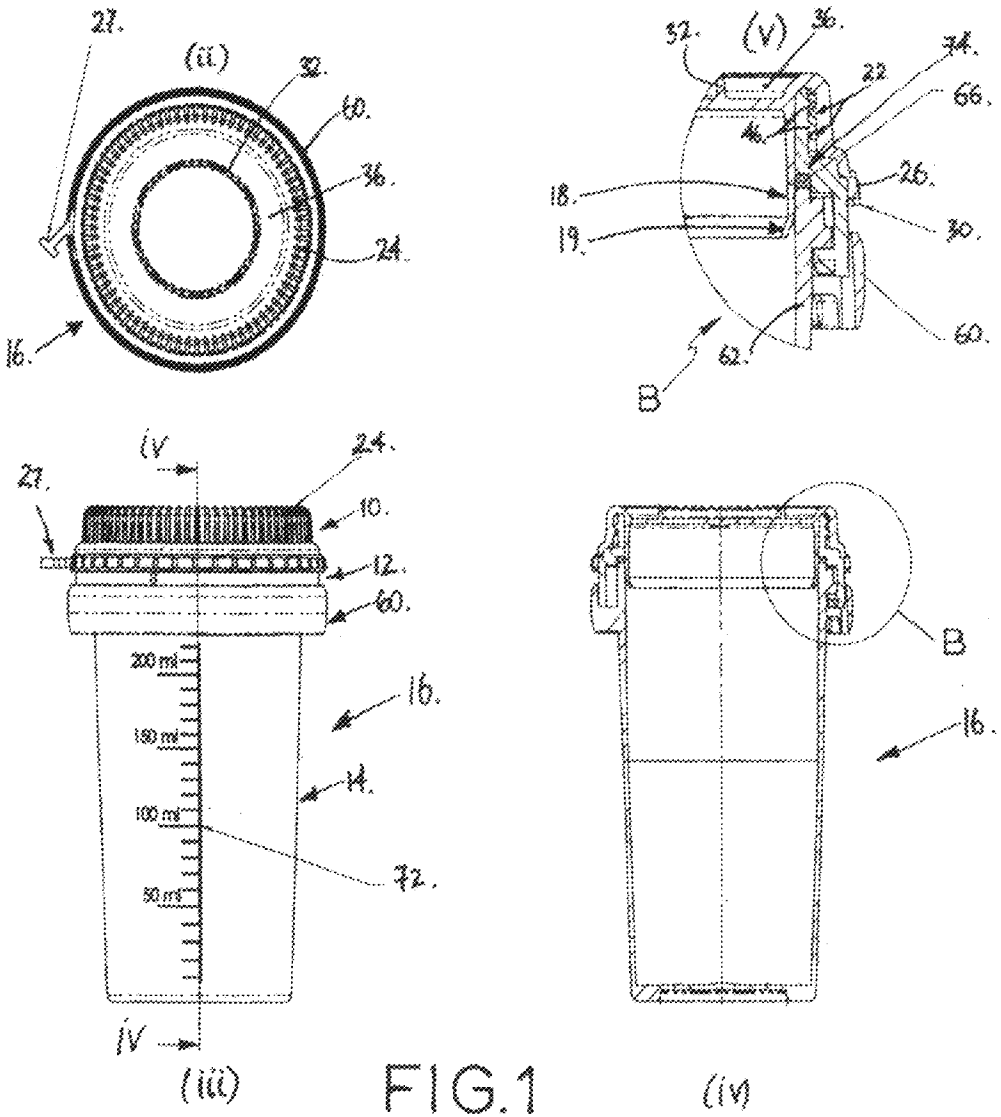
Figure 2:
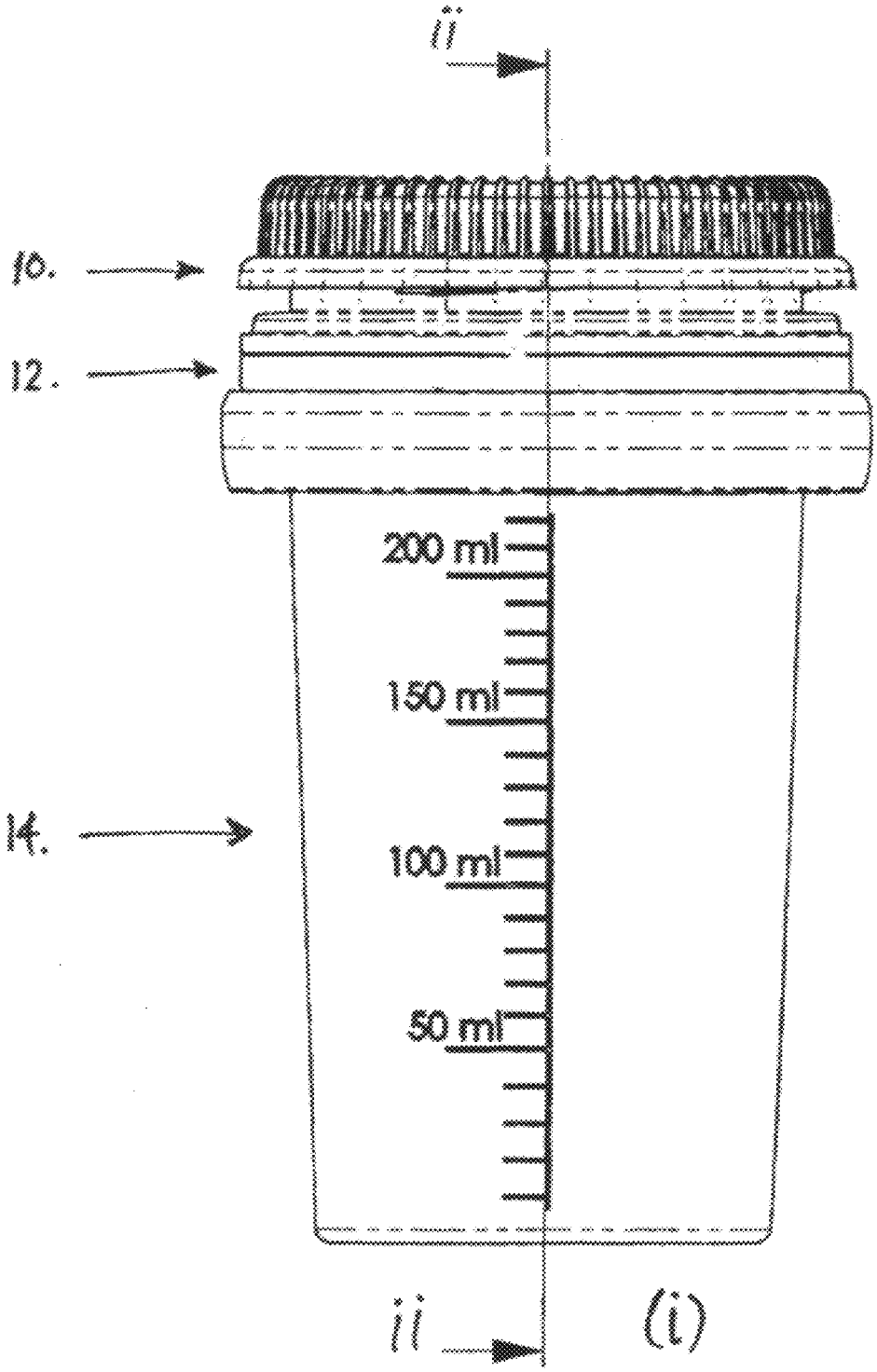
FIGS. 2(*i*), (*ii*) and (*iii*) respectively show side and side sectional elevations, and a side sectional detail, of the two-part lid and jar embodiment of FIG. 1 in a semi-open position (tear band removed, lid unscrewed)
Figure 2:
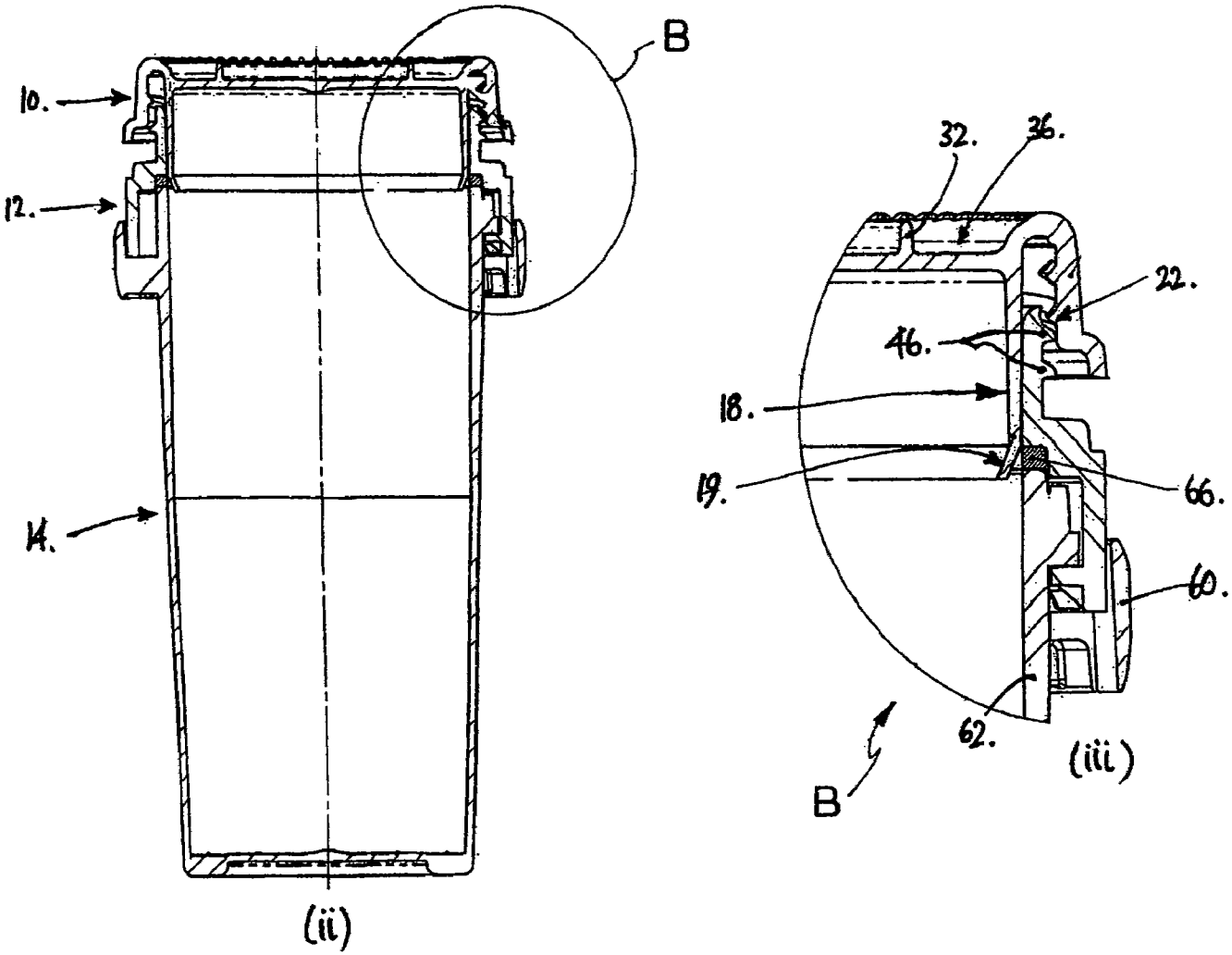

Referring firstly to the embodiment of FIGS. 1 and 2, a closure is shown in the form of a two-part lid arrangement comprising a lid top 10 and a lid base 12. The combined lid top/base is mounted to a container in the form of a jar 14, with the resulting lid/jar arrangement 16 being very secure, tamper proof and tamper evident (FIG. 1(*iii*)). The arrangement 16 can be used to house/store, transport and dispense a range of substances including solids, liquids and gases, and especially sensitive, vulnerable, secretive or valuable substances such as human and animal specimens, biopsies, jewels and valuable stones, jewellery, film and information disks etc.

It will be seen that the lid top 10 comprises an internal skirt 18, having an inwardly flared end portion 19, and an external skirt 20. The external skirt 20 has an internal thread 22 for coupling to a corresponding skirt on the lid base 12.

An external surface of the external skirt 20 is provided with a plurality of elongate ribs or grips 24 which facilitate grasping of the lid top 10 to enable it to be unscrewed and removed from or screwed onto and attached to the lid base 12. The ribs or grips 24 may be integrally moulded with the lid top 10, or may be overmoulded in a subsequent overmoulding step. They may, for example, be formed from a thermoplastic elastomer (TPE) or a thermoplastic rubber (TPR), the deformability of which enhances the gripping/grasping of the lid top during screwing/unscrewing to/from the lid base.

It will be seen that a lower edge of the external skirt 20 has a tear band 26 subtending therefrom, the tear band being positionable adjacent to an external wall of the lid base 12 (as described below). A tear band grip tab 27 is provided as part of tear band 26 to enable initiation of tear band removal. A plurality of grooves 28 are also defined in the tear band, and these are arranged to receive a TPE or TPR overmoulding 30 therein once the lid top has been screwed onto the lid base (ie. in a subsequent overmoulding step). The grooves 28 help fasten the overmoulding to the lid top, to thereby provide for better attachment of the tear band 26 to the lid base 12 (as described below). After the lid top has been attached to the lid base, the overmoulding 30 is moulded to also attach to the lid base (as described below).

It will be further seen that the lid top 10 is provided with a stacking ring formation 32 which is sized to position within a stacking recess 34 in an overlying-like jar 14. The stacking ring formation 32 and the internal skirt 18 combine to define an annular groove 36 within the lid top 10, into which an annular shaped base 38 of a like jar 14 can be received during stacking of two or more assembled lid/jar arrangements 16.

The lid base 12 comprises an external downwardly projecting skirt portion 40 connected to an internal upwardly projecting skirt portion 42 via a land 44. The internal skirt portion 42 is received in and between the internal and external skirts 18,20 of the lid top when the lid top is mounted to the lid base. In this regard, to releasably fasten the lid top to the lid base, the internal skirt portion 42 is provided with an external thread 46 which engages with the internal thread 22 of the lid top to enable the lid top to be screw mounted to and unscrewed from the lid base.

When the lid top is being mounted to the lid base, it will be seen that the inwardly flared portion 19 of skirt 18 enables skirt 18 to be easily inserted into the aperture defined by the internal skirt portion 42. In this regard, an internal bevel 48 is provided at an upper end of the internal skirt portion 42 and against which the inwardly flared portion 19 can ride, to centre the internal skirt during insertion into the lid base aperture.

The lid base 12 also comprises a series of (typically three) equally spaced bayonet lugs 50 extending inwardly from the external skirt portion 40. These lugs interengage with respective bayonet receptions lugs 52 provided on the jar (as described below). In addition, adjacent to each bayonet lug 50, projecting inwardly of the external skirt portion 40, and adjacent to an under side of land 44, are a series of (typically three) equally spaced anti-rotation locking lugs 54. Each of these locking lugs engages with and causes an inward deflection of respective anti-rotation locking spring-fingers 56 defined on the jar 14 (as described below).

Referring now to the jar 14, the jar comprises a projecting circumferential generally L-shaped flange 60, the flange extending out from jar wall 62. The upstanding wall of flange 60 is shaped so as to at least partially cover the bayonet reception lugs 52, but to also provide a circumferential recess 64 into which the external skirt portion 40 can be received when the lid base is mounted to the jar. In this regard, the external skirt portion 40 of the lid base covers all of the bayonet lugs 50, the reception lugs 52, the locking lugs 54 and the spring-fingers 56, thus preventing them from being tampered with once the lid base 12 has been mounted to the jar 14.

It will be seen that the upper end of the jar wall 62 can have a deformable gasket 66 positioned thereat prior to mounting the lid base to the jar. The function of the gasket is described in detail below with reference to FIG. 1(*v*).

It will also be seen that the jar base comprises an internal land 68 which, in addition to the annular-shaped base 38, is connected to the jar wall 62 by a plurality of support ribs 70. Furthermore, the jar can be provided with volume indicator markings 72 to indicate the volume of liquid or flowable solid therein (ie. when the jar wall is transparent or translucent).

Referring now to FIGS. 1(*iii*) to 1(*v*), the assembled arrangement 16 is shown. In this regard, lid top 10 has been fitted to lid base 12 and the overmoulding 30 has been applied thereto. When the overmoulding 30 is applied around the band 26, because it is molten, it causes a fusing of the band 26 to the overmoulding 30 and of the overmoulding 30 to the external skirt portion 40. This fastens the lid top to the lid base, as best depicted in FIG. 1(*v*). Typically the lid top is first attached and fastened to the lid base, prior to the lid base being attached to the jar. In other words, the assembled and fastened lid top/base combination can be supplied in a pre-assembled format and may then be attached to jars of varying sizes (but typically having a standard opening dimension).

When mounting the lid base 12 to the jar 14, the bayonet lugs 50 are typically vertically offset from their respective bayonet reception lugs 52 and the external skirt portion 40 is then moved downwardly so that it is inserted into recess 64. Once fully inserted the lid base is then rotated (clockwise in the embodiments shown in the drawings) and during such rotation each bayonet lug 50 passes under and is urged downwardly and into locking engagement with a respective bayonet reception lug 52. At the same time, each locking lug 54 engages with and deforms inwardly a respective locking spring-finger 56 until it moves fully therepast. After fully moving therepast, the spring-finger deflects back outwardly, thereby preventing counter-rotation of the lid base with respect to the jar (ie. with counter-rotation the locking lug 54 then engages with an end of its respective spring-finger 56 to prevent further counter-rotation). In other words, the lid base is effectively permanently locked to the jar and, when so locked, the locking mechanism is shrouded by the skirt portion 40 and the flange 60. Thus, the only way to remove the lid base from the jar is to effectively destroy the locking mechanism between it and the jar.

Referring specifically now to FIG. 1(*v*) the three-way sealing provided by gasket 66 will now be described. In this regard, when the lid top 10 has been mounted to the lid base 12, the combined top/base is then mounted to the jar (as described above). During this mounting, with progressive rotation of the lid base 12 on the jar 14, the bayonet lugs 50 engage with their respective reception lugs 52, and the reception lugs cause the lid base 12 to be drawn (urged) downwardly. This causes an underside stepped region or rebate 74 of land 44 to receive and squeeze down on the deformable gasket 66, causing the gasket to deform inwardly of the lid base. Because the internal skirt 18 of the lid top 10 is positioned adjacent to the gasket when the lid top/base has been mounted to the jar, the gasket is thus caused to be squeezed against the internal skirt. Accordingly, because of this unique configuration, the gasket 66 seals between the jar and the lid base, between the jar and the lid top, and between the lid top and the lid base. In other words, a three-way sealing function is provided with a single gasket. This substantially simplifies manufacture of the lid/jar arrangement 16 and also enables a very effective seal to be provided. In addition, when the lid top is removed from the lid base, the seal is still maintained between the lid base and the jar. Then, on reattachment of the lid top to the lid base, the gasket once again comes into sealing engagement with the lid top, again resealing the whole arrangement.

FIG. 1(*v*) also shows the arrangement of the overmoulding 30 around the tear band 26. As depicted, the overmoulding provides a hermetic seal between the lid top and the lid base, and also fastens the lid top to the lid base.

In use, once a suitable substance has been placed into the jar, the pre-assembled lid top/base is then mounted onto the jar (as described above). Thus, the substance is hermetically sealed within the jar and is ready for transportation, storage and then subsequent access/utilisation.

To access the substance, a use of grasps tear band tab 27 (usually between the index finger and thumb) and pulls on that band to cause a severance between the band and the lid top external skirt 20. At the same time, this causes the overmoulding 30 to sever between the tear band and its attachment to the lid base external skirt portion 40. It is for this reason that typically the overmoulding is formed from a thermoplastic elastomer (TPE) material or a thermoplastic rubber (TPR) material.

Once the tear band 26 has been fully detached, the lid top is now free to be unscrewed from the lid base. In this regard, a user grasps the lid top, with their hand gripping onto the ribs or grips 24, and unscrews the lid top. This brings the internal skirt 18 out of engagement with the gasket 66.

FIG. 2 illustrates the lid/jar arrangement 16 of FIG. 1, but with the tear band detached and with the lid top having been substantially unscrewed from the lid base, ready to be lifted therefrom. In this regard, it will be seen that the internal skirt 18 has moved out of engagement with gasket 66.

The substance within the jar can now be accessed (eg. for testing, retrieval, subsequent use). After use, the lid top can be re-screwed onto the lid base, and the gasket then reseals against the lid top internal skirt 18, thereby resealing any substance within the jar.

Figure 3:
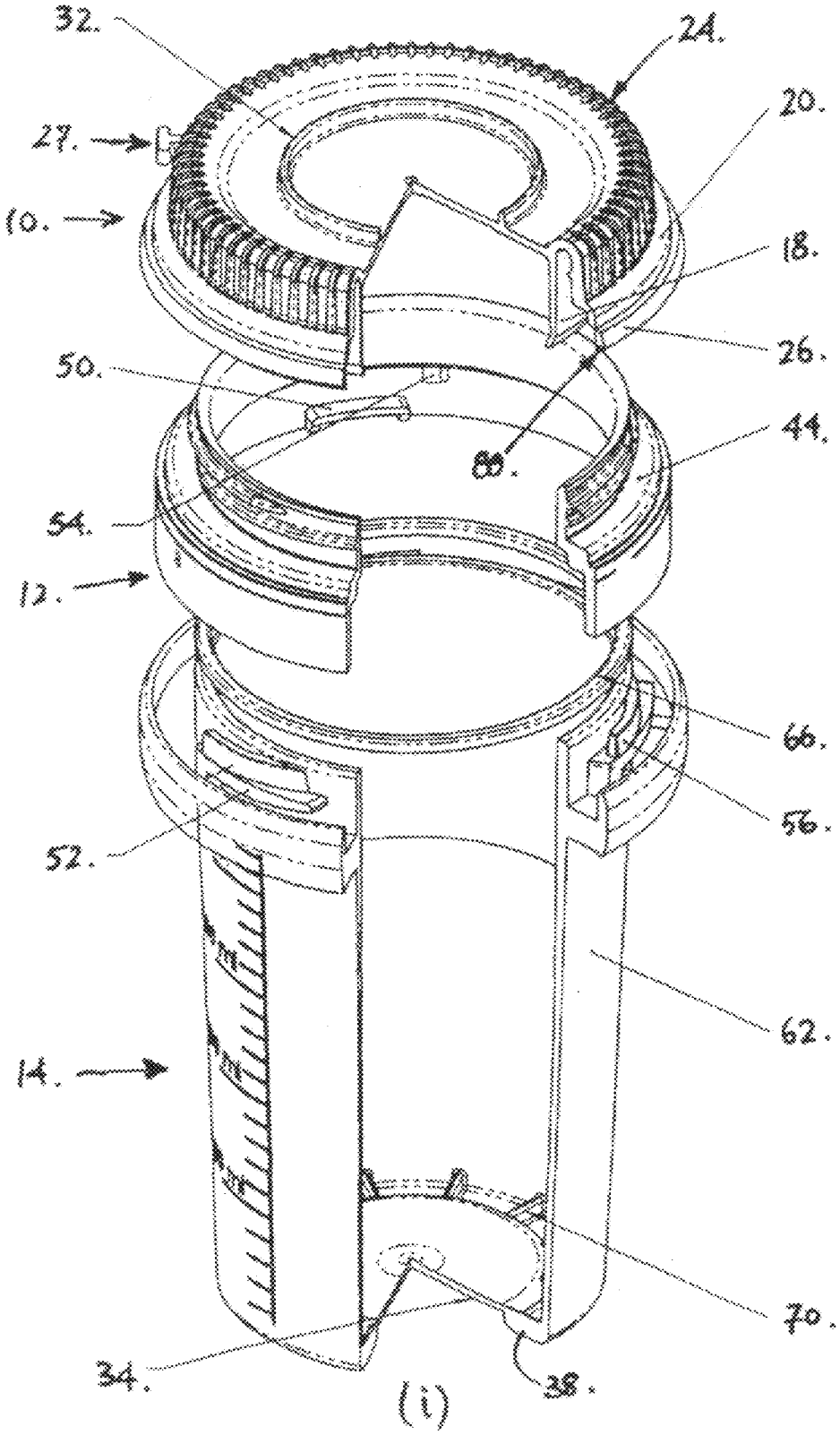
FIGS. 3(*i*), (*ii*), (*iii*), (*iv*) and (*v*) respectively show exploded perspective, assembled plan, assembled side, assembled side sectional elevations and an assembled side sectional detail of an alternative two-part lid embodiment and a jar embodiment suitable for use with the lid.
Figure 3:
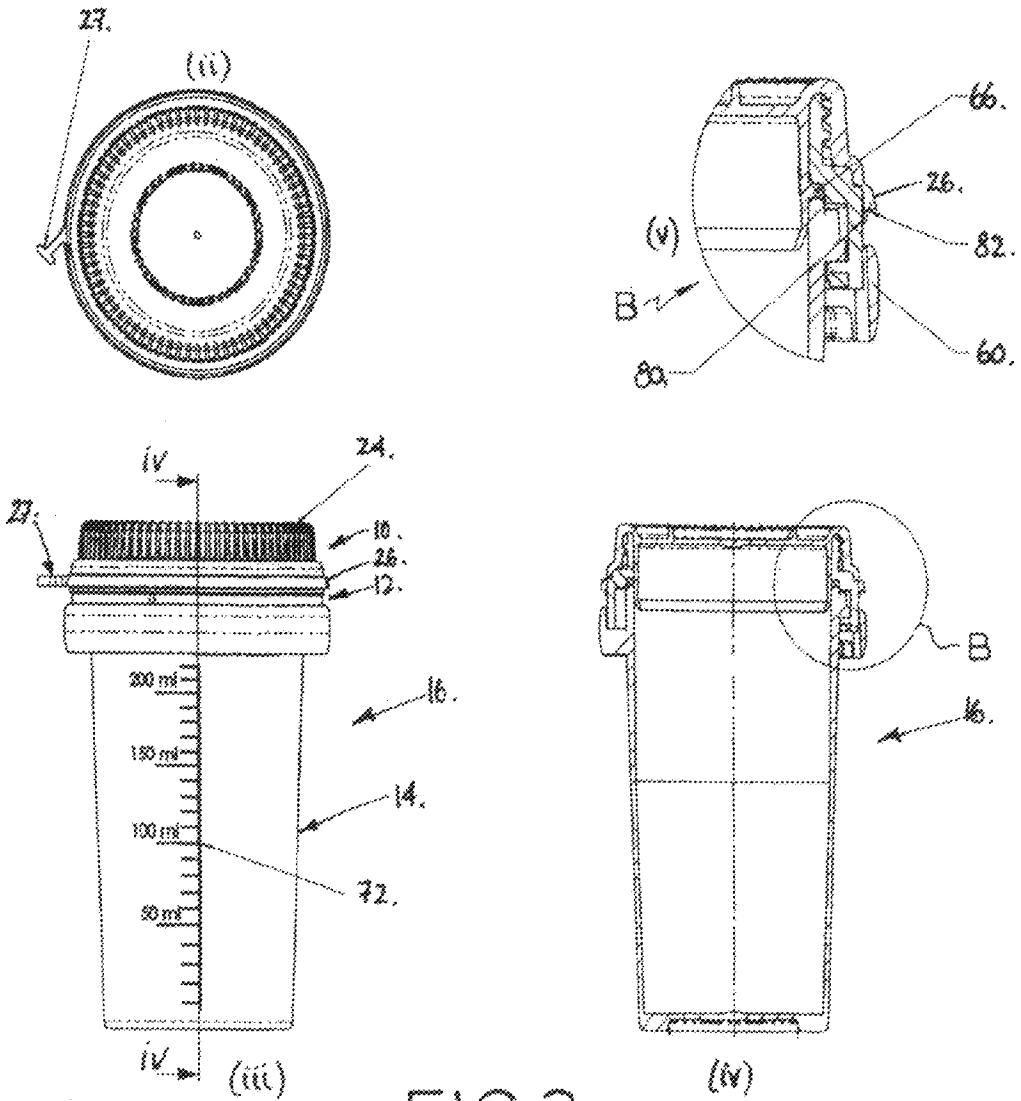

Referring now to FIG. 3, where like reference numerals are used to denote similar or like parts, it will be seen that the essential construction of the lid/jar arrangement 16 is similar to that of FIGS. 1 and 2. However, in this embodiment the tear band 26 comprises a circumferential weld skirt 80 subtending from a lower edge of the tear band around its circumference.

As best shown in FIG. 3(*v*) the weld skirt 80 is positioned in proximity of the lid base external skirt portion 40 when the lid top has been screw mounted to the lid base. Once so positioned, the weld skirt 80 may now be welded to the external skirt portion 40 to fasten the lid top to the lid base. In this regard, heat welding, ultrasonic welding or chemical welding may be employed to fasten the weld skirt 80 to the skirt portion 40.

Again, in use, once the user grasps tear band tab 27 and pulls it to detach the entire tear band 26 from the remainder of the lid top, the tear band is caused to sever from the weld skirt 80, typically along a circumferential notch 82 (or line of weakness). The weld skirt 80 thus provides as alternative and simple method for fastening the lid top to the lid base, whilst still allowing easy tear band removal.

The remainder of the function of the lid/jar arrangement of FIG. 3 is similar to that of FIG. 1, and will not be redescribed.

Figure 4:
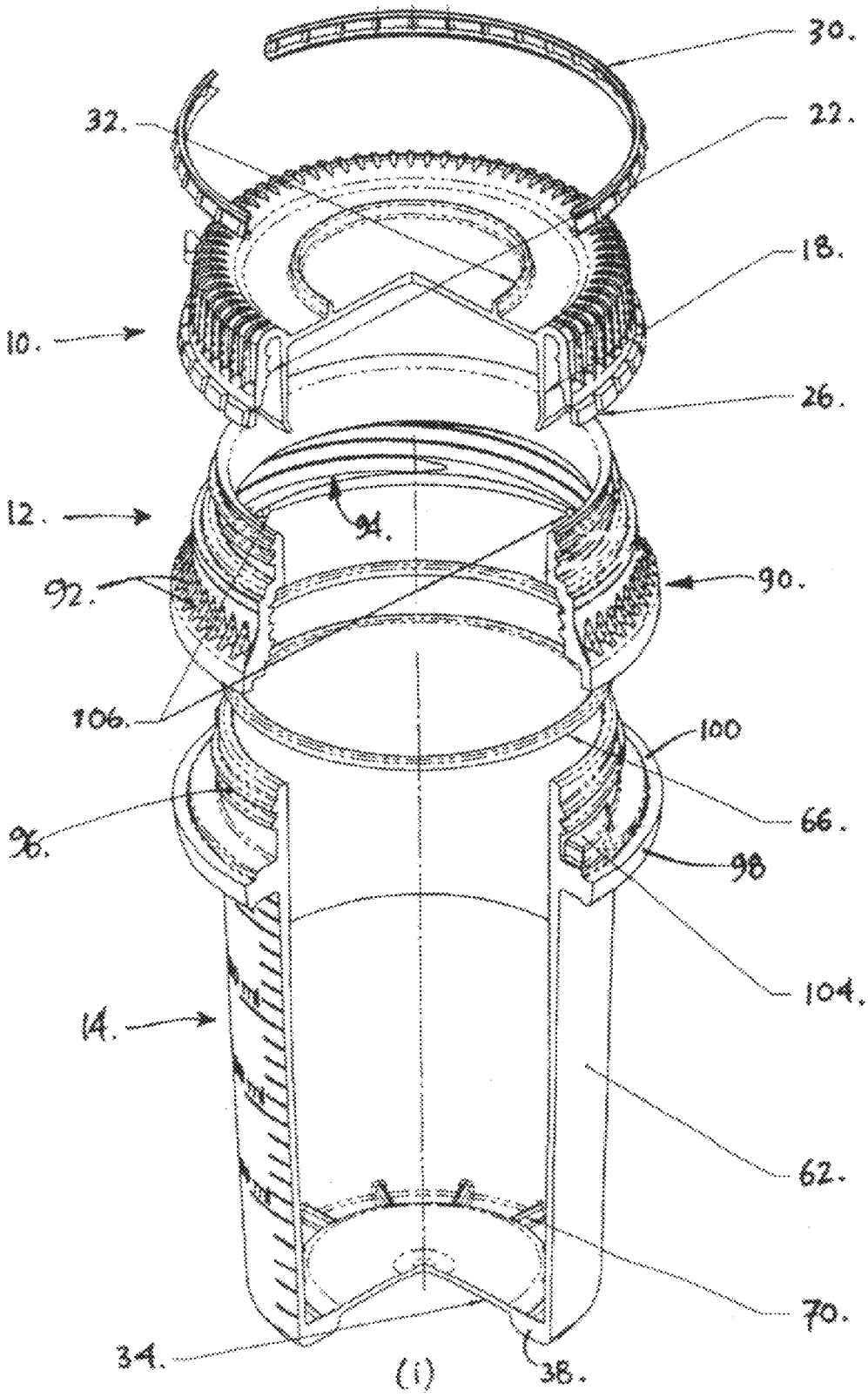
FIGS. 4(*i*), (*ii*), (*iii*), (*iv*) and (*v*) respectively show exploded perspective, assembled plan, assembled side, assembled side sectional elevations and an assembled side sectional detail of a further alternative two-part lid embodiment and an alternative jar embodiment suitable for use with the lid.
Figure 4:
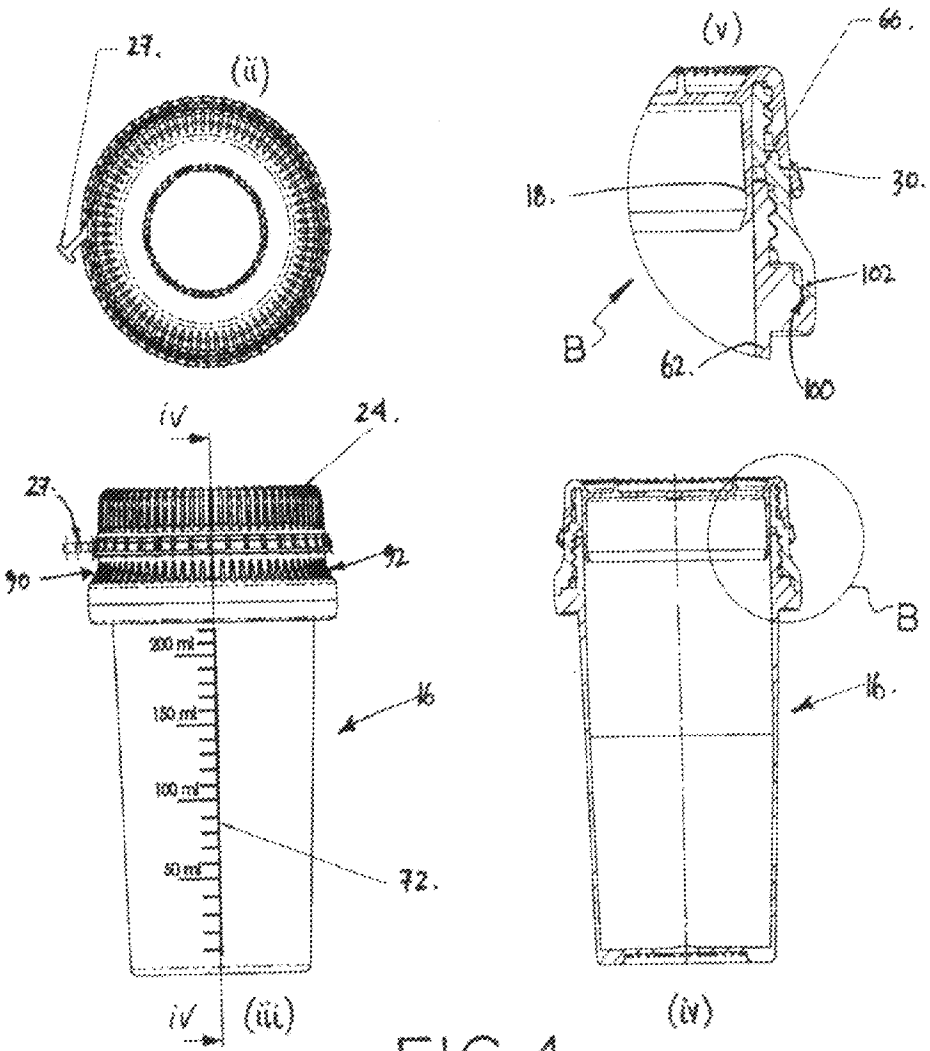

Referring now to FIG. 4, where like reference numerals are used to denote similar or like parts, it will be seen that the construction of the lid/jar arrangement is similar to the arrangements of FIGS. 1 to 3, but in this case the mounting between the lid base and jar is modified.

In this regard, the external skirt portion 40 of FIGS. 1 to 3 is replaced with a modified skirt portion 90 having a plurality of gripping webs 92 formed on the outside thereof, to enable gripping of the lid base during screw mounting to and dismounting from the jar. A multi-start thread 94 is defined on an internal face of the skirt portion 20 and engages with a corresponding multi-start thread 96 defined at an upper external end (rim) of the jar wall 62.

The L-shaped flange 60 is also replaced by a generally laterally extending flange 98, having a stepped rebate 100 defined therein for receipt of a corresponding skirt extension 102 of skirt portion 90. Thus, when the lid base 12 is mounted to the jar 14, the skirt extension 102 is received in the stepped rebate 100 (as best shown in FIGS. 4(*iv*) and 4(*v*)). This configuration, again, prevents the locking arrangement between the lid base and jar from being accessed and tampered with.

To lock the lid base to the jar, a series of (typically three) equally spaced anti-rotation locking fingers 100 are defined above the flange 98 and extend out from the jar wall. These fingers engage with respective anti-rotation locking lugs 106 arranged within the skirt portion 90, and located at the end of a respective thread run. Thus, when the lid base is screwed onto the jar, eventually the locking lugs 106 engage with the locking fingers 100, causing the skirt portion 90 to be deflected outwardly as the lugs ride past the locking fingers. Once having moved fully therepast, the lugs and hence the skirt portion snap back inwardly. This then prevents a counter-rotation of the lid base from the jar, thereby locking the base to the jar. Again, the lid base can only effectively be removed from the jar by destroying the locking arrangement.

In other respects the construction and operation of the lid/jar arrangement 16 of FIG. 4 is similar to that as described for FIGS. 1 and 2.

Figure 5:
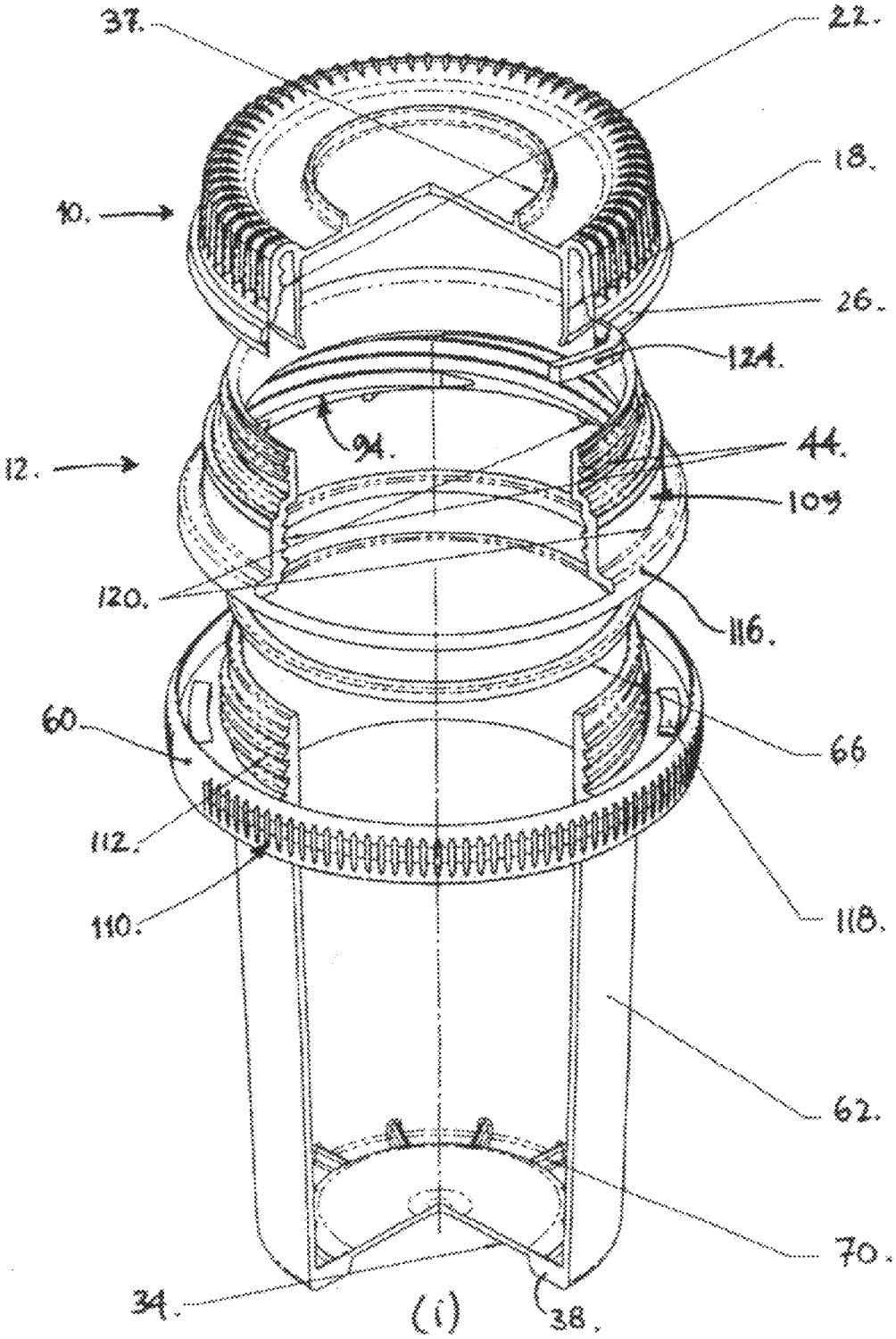
FIGS. 5(*i*), (*ii*), (*iii*), (*iv*), (*v*) and (*vi*) respectively show exploded perspective, assembled plan, assembled side, assembled side sectional elevations, assembled side sectional detail, and another assembled side sectional detail of yet a further alternative two-part lid embodiment and an alternative jar embodiment suitable for use with the lid.
Figure 5:
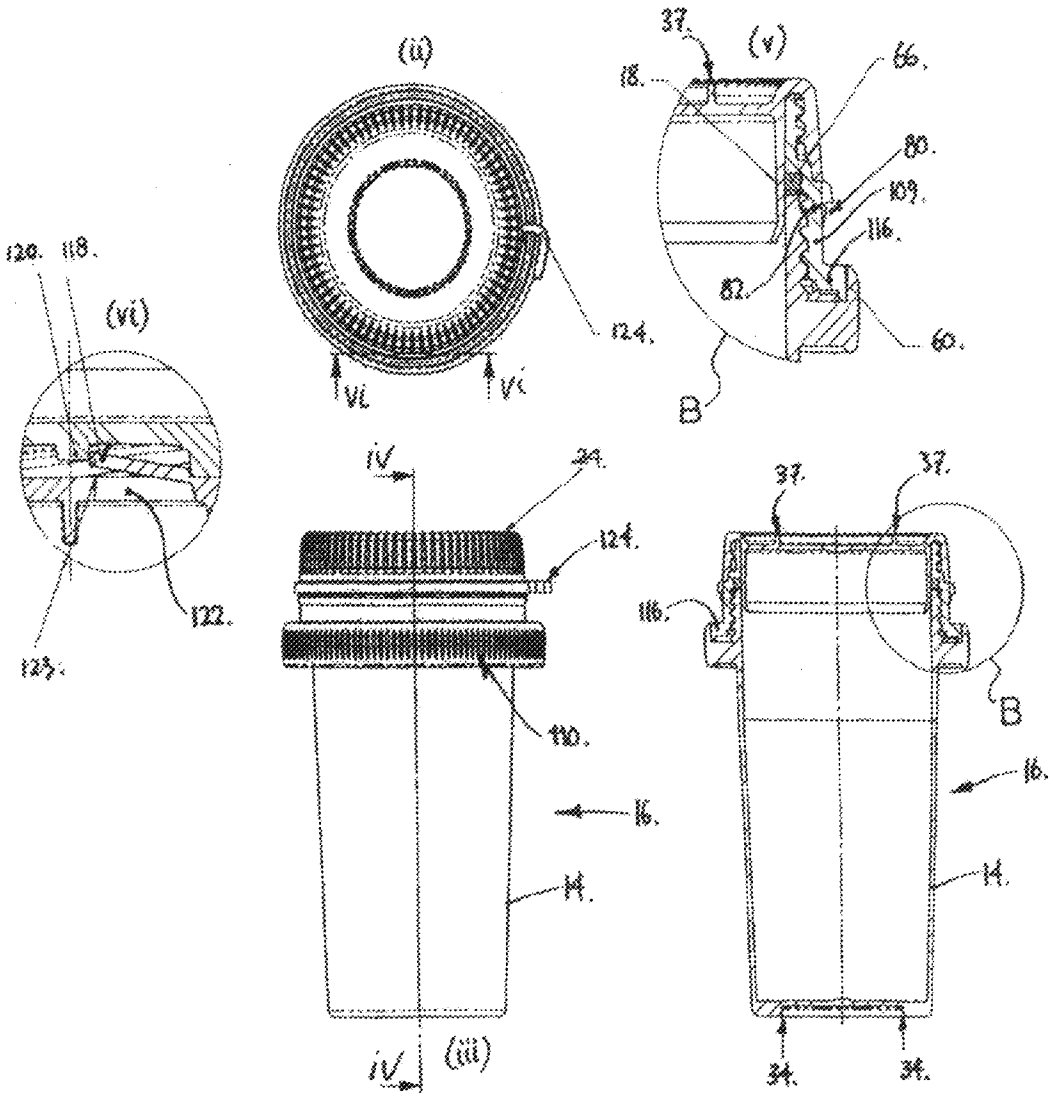

Referring now to FIG. 5, where like reference numerals are used to denote similar or like parts, it will be seen that the construction of the lid/jar arrangement is similar to the arrangement of FIG. 4, but in this case the mounting between the lid base and jar is again modified. In addition, the TPE/TPR overmoulding 30 of FIG. 4 is not employed, and rather the weld skirt 80 of FIG. 3 is employed.

In the embodiment of FIG. 5, the modified skirt portion 90 and plurality of gripping webs 92 is replaced with a skirt portion 109 more akin in structure to skirt portion 40. In addition, external gripping ribs 110 are now provided on the laterally extending flange 98.

In the embodiment of FIG. 5, the multi-start thread 94 is retained on the internal face of the skirt portion 20, but in this embodiment thread 94 engages with a full length thread formation 112 defined at the upper external end (rim) of the jar wall 62. This provides for an even greater force- and pressure-resistant retention of the lid on the jar in use.

Further, in the embodiment of FIG. 5, the L-shaped flange 60 of FIG. 3 is now re-employed and replaces the laterally extending flange 98 of FIG. 4. It will also be seen that a circumferential flange 116 extends laterally from skirt portion 109 to be received and engage in the recess 64. Thus, when the lid base 12 is mounted to the jar 14, the flange 116 is received snugly in the recess 64 (as best shown in FIGS. 5(*iv*) and 5(*v*)). This configuration, again, prevents the locking arrangement between the lid base and jar from being accessed and tampered with.

The circumferential flange 116 also assists with the locking of the lid base to the jar. In this regard, a series of (typically three) equally spaced anti-rotation locking spring fingers 118 are now defined in (eg. moulded into) the flange 60 at the base of recess 64. These fingers each extend into the recess 64 to engage with a respective anti-rotation locking barb 120 defined within and under the flange 116, during lid rotation mounting onto the jar.

In this regard, each barb moves over and deflects, and is eventually located past its respective finger at the end of screwing the lid onto the full thread run 112. More particularly, and as best shown in FIG. 5(*vi*), when the lid base is screwed onto the jar, eventually the locking barbs 120 engage with the spring fingers 118, causing them to be part-way deflected into respective finger recesses 122 defined in the flange 60, this deflection occurring as the barbs ride past the spring fingers. Once having moved fully therepast, the spring fingers spring back upwardly and capture the barb behind each finger's distal end. Again, this prevents a counter-rotation of the lid base from the jar, thereby locking the base to the jar.

Again, the lid base can only effectively be removed from the jar by destroying the locking arrangement. In this regard, a ledge 123 is provided to extend part-way into recess 122, to prevent the spring fingers 118 from being pulled downwardly and fully into the recess 122 from under the flange 60, which would otherwise free the barbs 120, and thus free the lid base for unscrewing.

Finally, it will be seen that the tear tab 124 in FIG. 5 has a different configuration to that shown in FIGS. 1 to 4.

In other respects the construction and operation of the lid/jar arrangement 16 of FIG. 5 is similar to that as described for FIGS. 1 to 4.

Manufacturing Methods

The lid top, lid base and jar are each injection moulded (eg using polypropylene). The use of a rigid polypropylene in moulding can prevent hypodermic syringe piercing/penetration of the jar and lid, in subsequent use of the lid/jar arrangement.

The container can be moulded in such a way as to provide multiple layers of plastic within a nominal wall section of the device (for example by sequenced injection). One of the resulting layers (typically a centre layer) can be formed of a material selected to provide a molecular barrier to the transfer of liquids and gases, including oxygen.

Alternatively, this barrier property can be achieved by applying a coating or lining of the material to the inside of the container. In addition, these barriers can be applied to all components of the device to result in a completely hermetic container.

After component moulding, the lid top and lid base are then screwed together and are re-inserted into a mould process for "overmoulding" with thermoplastic rubber (TPR), thermoplastic elastomer (TPE), silicon or a natural rubber etc, to thermally bond the top and base together. Each of the materials is selected to be compatible so that, after overmoulding, the top and base are locked and sealed together to provide a hermetic seal.

The tear band is moulded through a very thin membrane in polypropylene around the full circumference of the lid top so as to "seal" this side of the assembly during overmoulding. This stops the subsequent overmoulding rubber flowing in between the lid top and lid base, which would then prevent unscrewing of the lid top from the lid base.

In this regard, the tear band is compressed/crushed against the lid base when inserted into the overmoulding tool to "seal" the bottom side of the band against the lid base and prevent rubber ingress.

In the other technique for bonding/sealing the lid top to the lid base, a thin sleeve of plastic is moulded to subtend from the tear band on the lid top. This thin sleeve "sleeves" over the external wall of the lid base when the lid top is mounted to the lid base. The thin sleeve is then welded to the lid base around the circumference by heat welding, ultrasonic welding, chemical welding or a similar technique, or even attached thereto by adhesive.

The bayonet configuration can include "windows" in the jar flange to allow cheaper tooling. In this regard, in the tooling a line of draw can be employed instead of split blocks. The same technique can be applied to the spring fingers on the jar.

The size of the jar can be increased to allow a single urine, blood etc fill by a human male or human female or animal. The jar may be sized to also house test tubes for blood testing. Other sizes may be employed for uses such as housing precious stones and housing substances that require a controlled or secure transport mechanism.

Now that a number of embodiments of the lid and jar have been described in some detail it will be apparent that the following features are provided:

1. The arrangement can employ a single gasket that seals the lid base to the jar, the lid top to the lid base and the lid top to the jar.

2. The gasket provides a positive seal to the jar, the lid top, and the lid base, for example, in the case of internal pressure build-up and deformation (eg. due to boiling jar contents etc), and this sealing is provided right up to an extreme point where the lid top is blown off.

3. The gasket prevents any fluid ingress as the arrangement is heated and/or cooled. For example, it can prevent ingress where the arrangement is boiled upside down in water, can prevent a disturbing of the seal due to heat and pressure, and can also prevent ingress where the heated lid/jar arrangement is cooled down to cause a sucking in of contaminated fluid. Prior arrangements demonstrate insufficient tamper resistance in such circumstances (eg. an athlete could negate a positive test).

4. The lid top and lid base are sealed together to provide a hermetic seal (eg. via the overmoulding of rubber (such as TPE, TPR, silicon, natural rubber etc) or the welding of the tear band.

5. The tear band hermetically seals the lid/jar arrangement but then can be easily removed to allow the lid top and base to be easily separated by eg. unscrewing. The tear band can be removed in either direction. The tear band has a protruding starter tab for easy grasping, and the band is designed to be weak enough to tear but thick enough to mould and retain integrity prior to removal.

6. The lid top is designed such that its internal wall extends into the lid base to provide internal support to the lid when mounted to the container. The internal wall thus provides a type of barrel seal, providing internal support against lid compression and increasing the hoop strength of the lid.

7. The prominent ribs on the lid assist with lid closing and opening.

8. The lid base screw version (ie. which is screw mounted to the jar) provides an alternative to the bayonet mounting, and the screw threads can optimally resist fluid pressure within and outside the assembled lid/jar.

9. The assembled lid/jar provides both a tamper proof and tamper evident arrangement.

10. The assembled lid/jar is sufficiently integral that it can be spun in a centrifuge without first opening (eg. in the case of blood housing).

11. The two-part lid provides for resealability of the jar after initial opening for storage and reuse.

12. The integrity of the assembled lid/jar can provide for cold storage below freezing, with retained impact strength.

The assembled lid/jar can employ other features, accessories and arrangements. These may include:

The use of RFID tags on a jar or lid label (optionally or in addition to bar codes) for product tracking.

A female shaped beaker for attachment to the jar to collect urine to avoid mess and hassle.

In the case of eg. blood storage, the insertion of a coolant to maintain constant temperature, and to ensure a sample is maintained correctly during transport. The coolant may comprise a reusable cooling medium (eg. a freezable gel capsule/packet/block).

Numbers can be provided on the outside of the lid or jar for substance identification The use of different jar/lid colours for different tests and uses.

Use of the lid/jar arrangement in conjunction with security packaging for shipment and logistics.

On-line tracking of jar/lid movement with user interface over eg. the Internet.

The assembled lid/jar can house solids and all types of fluids such as liquids, flowable solids, and even gases. The jar can also be provided in a pliable form (eg. as a so-called "squeeze bottle").

All such constructions and applications remain within the scope of the lid and jar defined and described herein. Further, it should be appreciated that the lid and jar can be embodied in many other forms.

The invention claimed is:

1. A closure for a container, the closure comprising:

a first portion for mounting to the container; and a second portion comprising an internal skirt and an external skirt that surrounds a corresponding projecting wall of the first portion when the second portion is mounted thereto, such that:

(a) when the second portion is removed from the first portion it opens the container; and;

(b) when the first portion is mounted to the container and a deformable seal is positioned therebetween, and when the second portion is mounted to the first portion, the internal skirt is located adjacent to the seal, the seal is deformed and is simultaneously able to seal between the first portion and the container, and between the first portion and said internal skirt of the second portion.

2. The closure of claim 1 wherein, whilst the second portion is mounted to the first portion and the first portion is mounted to the container, the seal is caused to be forced inwardly against the internal skirt.

3. The closure of claim 1 wherein, once the first portion is mounted to the container, it is locked to the container by locking via one of a bayonet coupling and a screw thread coupling, with said coupling comprising an anti-rotational locking mechanism such that, during rotational mounting of the first portion to the container, the locking mechanism is engaged to prevent counter rotation and thus detachment of the first portion from the container.

4. The closure of claim 3 wherein, when the first portion is locked to the container, the anti-rotational locking mechanism is covered by an external subtending part of the first portion, with the external subtending part of the first portion being received into a recess defined in and around a peripheral flange projecting out from and surrounding the container.

5. The closure of claim 1 wherein the deformable seal is a gasket in the form of a deformable polymeric o-ring, the gasket being positionable in an internally located rebate within the first portion.

6. The closure of claim 1 wherein the first portion is mountable to a rim of the container located at and surrounding a container opening such that, when the first portion is mounted to the rim, the seal is engaged against a free end of the rim, and is sandwiched between an internal wall of the first portion and the rim free end.

7. The closure of claim 1 further comprising a screw thread positioned between the external skirt and corresponding projecting wall, such that the second portion can be screw mounted to the first portion.

8. The closure of claim 7 wherein a peripherally extending band subtends from a free edge of the external skirt, the band being located adjacent to the corresponding projecting wall when the second portion is mounted to the first portion, and wherein, after the second portion is mounted to the first portion, the band is fastened to the corresponding projecting wall.

9. The closure of claim 8 wherein the band is fastened to the corresponding projecting wall by one of:

a polymeric material that is a thermoplastic elastomeric or rubber material overmolded around the band; or a weld.

10. The closure of claim 9 wherein, when the band is welded to the corresponding projecting wall, it comprises a further peripheral skirt subtending from a free edge of the band, with the further peripheral skirt being welded to the corresponding projecting wall, with the further peripheral skirt frangibly connected to the free edge of the band.

11. The closure of claim 8 wherein the band is a tear strip frangibly connected to the edge of the external skirt such that it can be manually torn away therefrom, with the band comprising a protruding portion that enables manual initiation of tearing.

12. The closure of claim 1 wherein, when the first portion is mounted to the container it is locked thereto; and wherein, when the first portion is locked to the container, the second portion can be removed from the first portion to open the container.

13. The closure of claim 1 further comprising a peripherally extending band subtending from an end of the external skirt and located adjacent to the corresponding projecting wall when the second portion is mounted to the first portion;

wherein the band can be fastened to the corresponding projecting wall and can then be detached from the second portion, to enable the second portion to be detached from the first portion and thereby open the container.

14. The closure of claim 13 wherein the band is fastened to the corresponding projecting wall by one of:

a thermoplastic elastomeric or rubber material overmolded around the band; or a weld.

15. The closure of claim 14 wherein, when the band is welded to the corresponding projecting wall, it comprises a further peripheral skirt subtending from a free edge of the band, with the further peripheral skirt being welded to the corresponding projecting wall, with the further peripheral skirt being frangibly connected to the free edge of the band and also being frangibly connected to the external skirt such that it can be manually torn away from both the further peripheral skirt and external skirt.

16. The closure of claim 15 wherein the band is a tear strip and comprises a protruding portion that enables manual initiation of tearing.

* * * * *